United States Patent [19]

Hogan et al.

[11] 4,441,518

[45] Apr. 10, 1984

[54] COLLAPSIBLE SUPPORT FIXTURE FOR CAMOUFLAGE SCREENS OR THE LIKE

[75] Inventors: Mark J. Hogan, Lake Helen; Ernest R. Cooke, Deltona, both of Fla.

[73] Assignee: Brunswick Corporation, Skokie, Ill.

[21] Appl. No.: 362,318

[22] Filed: Mar. 26, 1982

[51] Int. Cl.[3] ..... A45F 1/16

[52] U.S. Cl. ..... 135/98; 135/20 M; 135/109; 135/901

[58] Field of Search ..... 135/98, 99, 120, 107, 135/16, 98, 20 M, 20, 901-903, DIG. 8, 106, 109; 160/368 R; 211/197, 195, 196; 403/171, 172, 334; 248/353, 345

[56] References Cited

U.S. PATENT DOCUMENTS

| | | | |
|---|---|---|---|
| 1,635,756 | 7/1927 | Leach . | |
| 1,903,209 | 3/1933 | Butler . | |
| 2,261,142 | 11/1941 | Davis | 160/368 R |
| 2,277,742 | 3/1942 | Crawford | 135/120 |
| 2,661,752 | 12/1953 | Kampf et al. . | |
| 2,839,069 | 6/1958 | Hickman | 135/901 |
| 3,374,798 | 3/1968 | Samuelson . | |
| 4,069,833 | 1/1978 | Johansson . | |

FOREIGN PATENT DOCUMENTS

| | | | |
|---|---|---|---|
| 95331 | 3/1932 | Australia | 135/98 |
| 1572672 | 8/1980 | United Kingdom | 211/197 |

*Primary Examiner*—Richard J. Apley

*Assistant Examiner*—S. R. Crow

*Attorney, Agent, or Firm*—William G. Lawler, Jr.; George J. Porter

[57] ABSTRACT

A collapsible support fixture is disclosed for use with camouflage screens, tenting, or the like. A vertical support shaft has a batten spreader support mechanism fixed generally to the top of the shaft for pivotal movement relative thereto between a collapsed position generally alongside the shaft and a spread position generally radially of the shaft. The support mechanism includes a support member fixed generally to the top of the shaft and a plurality of batten spreader support brackets hinged to the support member angularly about the axis of the shaft. A slide collar is slidable on the shaft. Link members are pivotally connected to the slide collar and individually to the batten spreader support brackets for moving the brackets between the collapsed and spread positions in response to sliding movement of the collar on the shaft. Over-center arms are rigidly fixed to the underside of the hinged support brackets to pivotally connect the link members. This effects an over-center arrangement to hold the batten spreader support mechanism in the spread position automatically when the slide collar reaches a predetermined position at the top of the shaft. The batten spreader support brackets releasably receive and mount individual batten spreader support arms whereby the arms can be readily assembled and individually replaced in the event of damage or breakage.

23 Claims, 7 Drawing Figures

FIG. 1
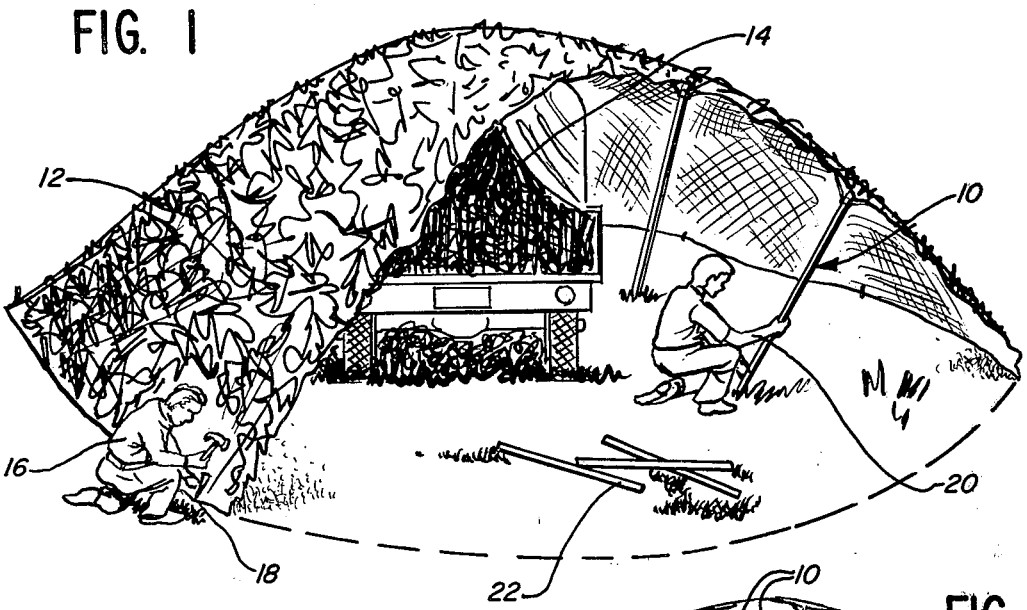
FIG. 2
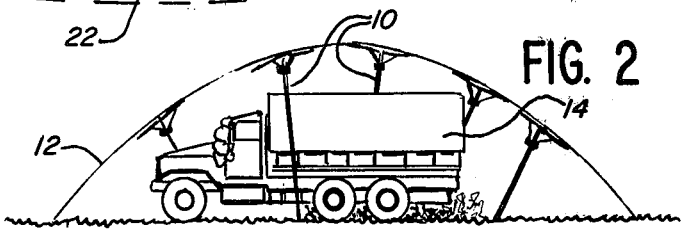
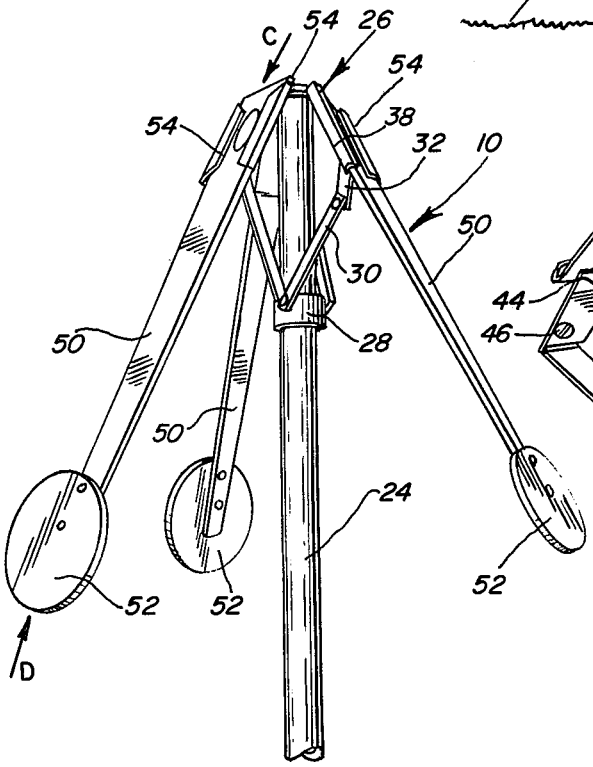
FIG. 3
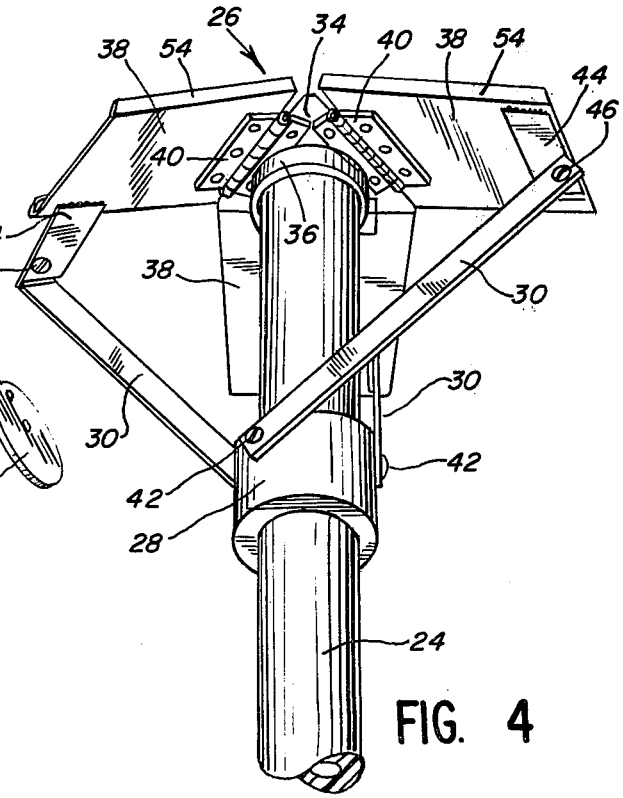
FIG. 4

COLLAPSIBLE SUPPORT FIXTURE FOR CAMOUFLAGE SCREENS OR THE LIKE

BACKGROUND OF THE INVENTION

This invention relates to a new and improved collapsible support fixture for camouflage screens, tenting, or the like.

Camouflage screens commonly are provided in modules of hexagonal or triangular sections which are assembled edge-wise to form a camouflage sheet of a desired size and configuration. Often, the size and configuration will depend upon the number or type of personnel or equipment to be covered and concealed by the camouflage screen. The screen usually is laid out on the ground, for instance, and staked at its corners or edges to cover a particular area or to conceal particular equipment. "Umbrella" type support fixtures then are raised beneath the screen to elevate the screen above the desired area or equipment. The umbrella support fixtures may be randomly disposed so as to achieve a random outline or contour for the overall screen.

Obviously, in military applications time may be of the essence and, in fact, quite critical. One of the major problems in this area is the cumbersome nature and construction of the vertical support fixtures or "umbrella" supports which are erected beneath the camouflage screen. These support fixtures often are collapsible and can be assembled and disassembled for transport. The camouflage screen itself can be employed very rapidly, but considerable time is lost in assembling and erecting the support fixtures beneath the camouflage screen. Often this is done by a single person who might not have much trouble in assembling the support fixture, but it presently is quite difficult with available fixtures to hold the fixture in place beneath the camouflage screen, elevate the fixture, and then have to lock the fixture in elevated condition to support the screen. It would be highly desirable to provide a collapsible support fixture which needs little assembly and which would automatically lock itself in elevated or spread condition simply by actuation of the elevating mechanism.

Another problem with such collapsible support fixtures of the character described is that the fixtures normally are used with standard batten spreader support arms. The batten spreader arms are like the "ribs" of an umbrella support mechanism. The arms have become standard items and are generally flat and flexible so as to maintain a constant tension on the camouflage screen when installed with initial preload against the arms. The use of such standard flexible batten spreader arms introduces the possibility of material fatigue over an extended period of time or possible field damage, causng a condition where it would be desirable to replace one or more of the batten spreader support arms. Heretofore, there has been no means for rapid interchangement of the arms without the use of hand tools. It would be desirable to provide a collapsible support fixture which would releasably receive and mount the individual batten spreader support arms whereby the arms can be readily assembled and disassembled and individually replaced in the event of damage or breakage without the use of any kind of tools.

The present invention is directed to solving these problems and satisfying these needs by providing a new and improved collapsible support fixture which is self-locking in a spread condition and which has rapid interchangement of the batten spreader support arms.

SUMMARY OF THE INVENTION

An object, therefore, of the present invention is to provide a new and improved collapsible support fixture for camouflage systems, tenting or the like.

Another object of the invention is to provide a collapsible support fixture of the character described which is self-locking in its spread or elevated condition.

A further object of the invention is to provide a collapsible support fixture of the character described wherein the batten spreader support means is readily assembled and disassembled and individually replaceable in the event of damage or breakage.

In the exemplary embodiment of the invention, a collapsible support fixture is provided for camouflage screen systems or the like, the support fixture including a vertical support shaft. Batten spreader support means is fixed to the shaft for pivotal movement relative thereto between a collapsed position generally alongside the shaft and a spread position generally radially of the shaft. Slide means in the form of a collar is slidable on the shaft. Link means connects the slide means and the batten spreader support means for moving the batten spreader support means between said positions in response to sliding movement of the slide means on the shaft. Over-center means holds the batten spreader support means in the spread position automatically when the slide means reaches a predetermined position along the shaft.

As disclosed herein, the batten spreader support means comprises a polygonal support plate fixed generally to the top of the support shaft. A plurality of batten spreader support brackets are hinged edge-wise to the support plate angularly about the axis of the shaft. The over-center means comprises short arms fixed to the underside of and depending from the batten spreader support brackets and pivotally connected to individual link members pivotally connected to the slide collar. Thus, the pivot points of the link members on the slide collar are above the pivot points of the link members on the over-center arms of the support brackets when the entire mechanism is in the spread position. This provides for self-locking of the batten spreader support means in the spread position automatically in response to the slide collar reaching a predetermined position, such as at the top of the shaft beneath the fixed support plate.

The batten spreader support brackets have means for releasably receiving and mounting individual batten spreader support arms whereby the arms can be readily assembled and disassembled and individually replaced in the event of damage or breakage. More particularly, each batten spreader support bracket includes tapered channel means for receiving one of the batten spreader support arms and holding the support arm by frictional engagement within the channel means. With this structure, rapid change of a batten support arm can be effected simply by tapping on the distal end of the arm to unseat the arm from its frictional engagement within the tapered channel means of the support bracket. No extraneous tools whatsoever are needed.

Other objects, features and advantages of the invention will be apparent from the following detailed description taken in connection with the accompanying drawings.

DESCRIPTION OF THE DRAWINGS

FIG. 1 is a somewhat schematic view illustrating the placement of the collapsible support fixtures of the present invention beneath a camouflage screen covering a vehicle, with a portion of the screen cut away to facilitate the illustration;

FIG. 2 is another view through a camouflage screen illustrating the positioning of a plurality of collapsible support fixtures beneath the camouflage screen;

FIG. 3 is a perspective view of the collapsible support fixture of the present invention, assembled with three batten spreader support arms;

FIG. 4 is a perspective view of the underside of the batten spreader support fixture in an intermediate operative position;

DETAILED DESCRIPTION OF THE INVENTION

Figure 5:
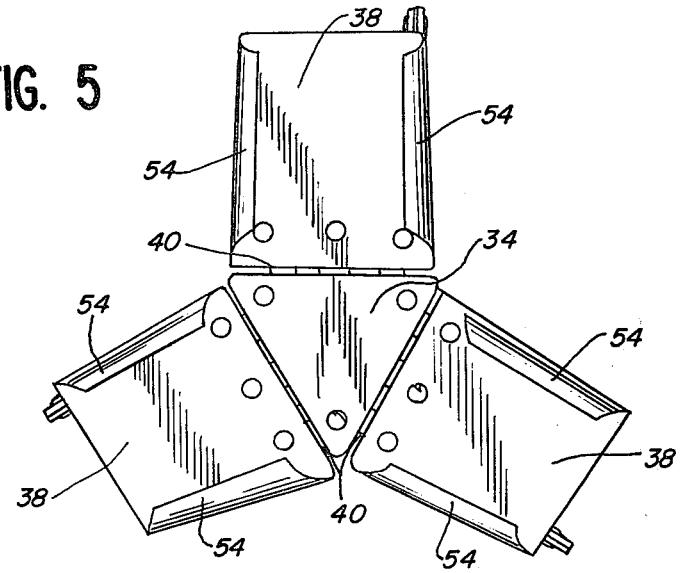
FIG. 5 is a top plan view of the batten spreader support means of the fixture of the present invention, including the top support plate and hinged support brackets.

Referring to the drawings in greater detail and first to FIGS. 1 and 2, the present invention is directed to a collapsible support fixture for camouflage screen systems or the like. In particular, collapsible support fixtures, generally designated 10, are used to support camouflage screens 12 in an elevated condition to cover and conceal personnel or equipment such as a vehicle 14. In use, camouflage screen 12 is laid out on the ground, for instance, and staked at its corners or edges to cover a desired area. An individual 16 is shown in FIG. 1 applying stakes 18 about the edge of the screen to secure the screen in place. A second individual 20 is shown positioning one of the collapsible support fixtures 10 to elevate the screen above the ground and over the concealed vehicle 14. A plurality of components 22 of the support fixture, such as batten spreader support arms described hereinafter, are shown on the ground prior to assembly. FIG. 2 shows a plurality of the collapsible support fixtures 10 in place elevating and supporting camouflage screen 12 above and concealing vehicle 14. Of course, the collapsible support fixture of the present invention is equally applicable for use with testing or other military or civilian applications.

In military applications time often is of the essence and, although a camouflage screen may be deployed and staked in position in a relatively short time, assembly and elevation of the collapsible support fixtures 10 often is a problem which could be critical. For instance, the individual (indicated at 20 in FIG. 1) responsible for elevating the collapsible support fixtures often has difficulty not only in assembling the fixtures but in elevating the fixtures from beneath the camouflage screen and yet be required to lock the fixtures in elevated condition. The present invention is directed to providing a new and improved collapsible support fixture which not only is simple and economical to manufacture, but which is simple to deploy and self-locking in extended or spread position. More particularly, referring to FIGS. 3 and 4, the collapsible support fixture 10 of the present invention includes a vertical support shaft 24, batten spreader support means generally designated 26, slide means 28, link means 30, and over-center means 32.

Shaft 24 may be fabricated of sturdy tubular material such as aluminum or fiberglass. The base of the shaft (not shown) may be flat or, if preferred, slightly pointed so as to prevent sliding movement of the fixture relative to the terrain.

Batten spreader support means 26 is fixed to the top of shaft 24 for pivotal movement relative thereto between a collapsed position generally alongside the shaft to a spread position generally radially of the shaft. The batten spreader support means includes a polygonal support plate 34 which has a cylindrical boss 36 integral with the bottomside thereof for positioning over the top of shaft 24. In the embodiment of the invention disclosed herein, support plate 34 is triangularly shaped, and three batten spreader support brackets 38 are pivotally connected edge-wise to support plate 34 angularly about the axis of shaft 24. For this purpose, hinges 40 (FIG. 4) pivotally connect support brackets 38 to support plate 34. Referring to FIG. 5, the angular disposition of support brackets 38 equally about the axis of the shaft is shown, with the edge-wise mounting of the brackets to support plate 34 by hinges 40.

Slide means 28 comprises a cylindrical collar which is easily slidable along shaft 24. Link means 30 connects slide collar 28 to batten spreader support means 26 for moving the batten spreader support means between the collapsed and spread positions in response to sliding movement of slide collar 28 on shaft 24. The link means comprises link members or arms 30 pivotally connected at points 42 (FIG. 4) to slide collar 38 generally tangentially of the periphery of the collar.

Figure 6:
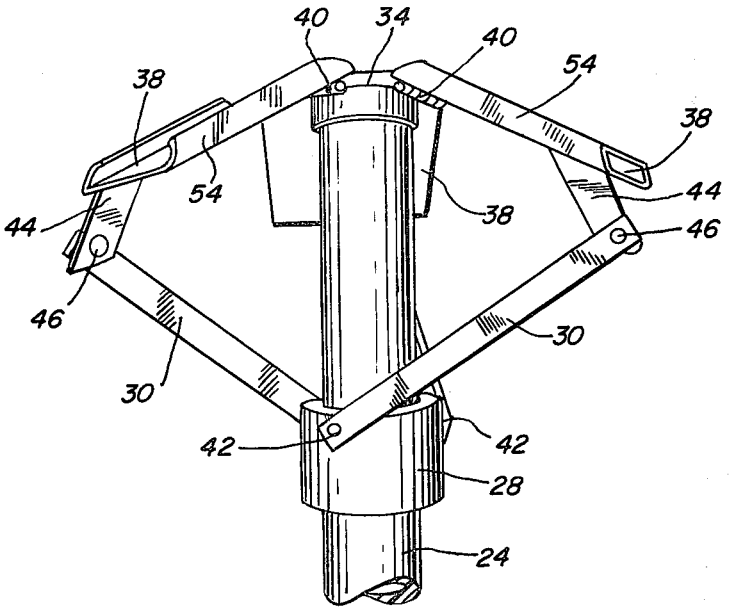
FIG. 6 is a side elevational view similar to that of FIG. 4.
Figure 7:
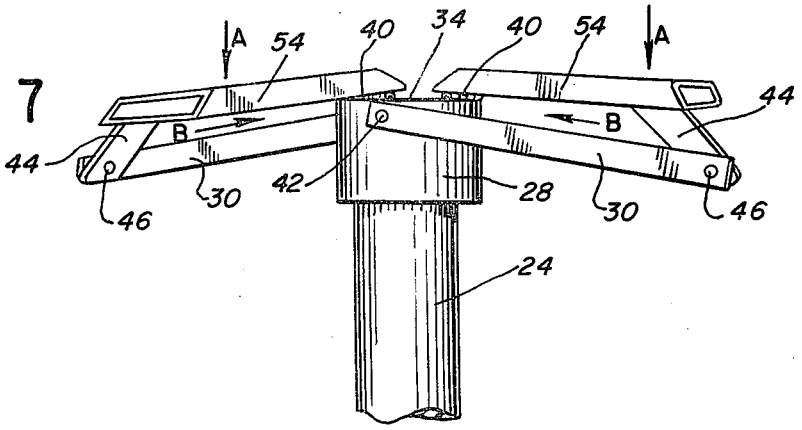
FIG. 7 is a side elevational view of the collapsible support fixture of the present invention in its fully self-locked condition.

The over-center means 32 for self-locking the batten spreader support means 26 in the spread position automatically when slide collar 28 reaches a predetermined position along shaft 24, is understood best in relation to FIGS. 4, 6 and 7. More particularly, the over-center means comprises short arms 44 rigidly fixed to the underside of and depending from the bottom of batten spreader support brackets 38. Link members 30 are pivotally connected to over-center arms 44 at points 46 near the lower, distal ends of the arms. FIGS. 4 and 6 show the support fixture in a somewhat intermediate position with slide collar 28 spaced a distance down from the top of shaft 24. However, FIG. 7 shows slide collar 28 moved completely to the top of shaft 24 into abutment with the underside of support plate 34 and hinges 40. In this fully extended or spread condition of the support fixture, it can be seen that pivot points 42 between link members 30 and slide collar 28 are disposed above or "over-center" pivot points 46 between link members 30 and over-center arms 44. In essence, pressure exerted by the camouflage screen onto the top of the collapsible support fixture actually tends to lock the support fixture in its extended position more securely. This can be seen by the direction of arrows "A" in FIG. 7 which represent downward pressure of the camouflage screen onto the fixture. The horizontal component of these pressure arrows are directed in an upwardly inclined direction as represented by arrows "B". These upward arrows represent forces exerted by link members 30 to drive slide collar 28 upwardly of shaft 24 and into locked abutment with the underside of support plate 34 and hinges 40. This upward component of forces is effected by the disposition of pivot points 46 on the lower ends of over-center arms 44 below the pivot points 42 of link members 30 on slide collar 28.

Another feature of the invention is the provision of means for releasably receiving and mounting individual batten spreader support arms 50 (FIG. 3) whereby the batten spreader support arms can be readily assembled and disassembled and individually replaced in the event of damage or breakage. More particularly, batten spreader support arms are flexible radial arms which will maintain a constant tension on the camouflage screening when installed with initial preload against the arms such as by the weight of the screen. Enlarged circular discs 52 are secured to the ends of the batten spreader support arms to further distribute support for the camouflage screen. However, the use of flexible radial arms introduces the possibility of material fatigue over an extended period of time or possible field damage, causing a condition where it would be desirable to replace one or more of these radial arms. It can be seen in FIG. 3 that the arms are tapered in a narrowing manner toward the distal ends of the arms. Referring to FIG. 5, it can be seen that batten spreader support brackets 38 also are complementarily tapered and are provided with channel means in the form of inwardly directed flanges 54 along opposite side edges of the brackets. The tapered channel means afforded by flanges 54 releasably receive the batten spreader support arms 50 and hold the support arms by frictional engagement beneath and within flanges 54. Thus, referring to FIG. 3, the batten spreader support arms are assembled within and between flanges 54 generally in the direction of arrow "C" without the need of any tools whatsoever. In order to disassemble or replace one or more of the batten spreader support arms, a slight inward tap on the distal ends of the arms, in the direction of arrow "D" in FIG. 3, will unseat the arms from the support brackets and allow replacement arms to simply be slid into place. This design also prevents the arms from being dislodged from their brackets in a deployed or collapsed mode.

It will be understood that the invention may be embodied in other specific forms without departing from the spirit or central characteristics thereof. The present examples and embodiments, therefor, are to be considered in all respects as illustrative and not restrictive, and the invention is not to be limited to the details given herein.

What is claimed is:

1. A collapsible support fixture for camouflage screen systems or the like, comprising:

a shaft;

batten spreader support means for readily releasably receiving and mounting a plurality of individual batten spreader support arms for supporting said camouflage screen, said support means being fixed to said shaft for pivotal movement relative thereto between a collapsed position generally alongside said shaft and a spread position generally radially of said shaft;

slide means slidable on said shaft;

link means connecting said slide means to said batten spreader support means for moving said batten spreader support means between said positions in response to sliding movement of said slide means on said shaft; and over-center means to hold said batten spreader support means in said spread position automatically when said slide means reaches a predetermined position along said shaft.

2. The collapsible support fixture of claim 1 wherein said batten spreader support means are pivotally connected to said shaft, said link means are pivotally connected to said slide means, and said over-center means comprises arm means fixed to and depending from said batten spreader support means and pivotally connected to said link means.

3. The collapsible support fixture of claim 2 wherein the pivot points of said link means on said slide means are above the pivot points of said link means on said depending arm means when said batten spreader support means are in said spread position.

4. The collapsible support fixture of claim 3 wherein said batten spreader support means comprises a support member fixed generally to the top of said shaft and a plurality of batten spreader support brackets pivotally connected to said support member angularly about the axis of said shaft.

5. The collapsible support fixture of claim 4 wherein said batten spreader support brackets each has means for readily releasably receiving and mounting one of said batten spreader support arms for supporting said camouflage screen.

6. The collapsible support fixture of claim 4 wherein said support member at the top of said shaft comprises a polygonal support plate defining a plurality of edges along each of which one of said batten spreader support brackets is hinged.

7. The collapsible support fixture of claim 3 wherein said slide means comprises a collar and said link means comprises a plurality of link arms pivotally connected to said collar generally tangentially of the periphery thereof.

8. In a support fixture for camouflage screen systems or the like wherein batten spreader support means are fixed to a shaft for pivotal movement relative thereto between a collapsed position generally alongside the shaft and a spread position generally radially of the shaft, the improvement comprising means on said batten spreader support means for readily releasably receiving and mounting individual batten spreader support arms by frictional engagement whereby the batten spreader support arms can be readily assembled and disassembled and individually replaced in the event of damge or breakage.

9. In a support fixture as set forth in claim 8, wherein said batten spreader support means includes a plurality of batten spreader support brackets for individually and releasably receiving and mounting said batten spreader support arms.

10. In a support fixture as set forth in claim 9, wherein said batten spreader support brackets each include means for receiving one of said batten spreader support arms by a sliding engagement.

11. In a support fixture as set forth in claim 9, wherein said batten spreader support means includes a support member fixed generally to the top of a support shaft, and said batten spreader support brackets are pivotally connected to said support member angularly about the axis of said shaft.

12. In a support fixture as set forth in claim 11, wherein said support member at the top of said shaft comprises a polygonal support plate defining a plurality of edges along each of which one of said batten spreader support brackets is hinged.

13. In a support fixture as set forth in claim 11, including slide means slidable on said shaft, and link means connecting said slide means to said batten spreader support brackets for moving the batten spreader support means between said positions in response to sliding movement of said slide means on said shaft.

14. In a support fixture as set forth in claim 13, including over-center means to hold said batten spreader support means in said spread position automatically when said slide means reaches a predetermined position along said shaft.

15. A collapsible support fixture for camouflage screen systems or the like comprising:

a support shaft;

batten spreader support means fixed generally to the top of said shaft for pivotal movement relative thereto between a collapsed position generally alongside said shaft and a spread position generally radially of said shaft, said support means comprising a support member fixed generally to the top of said shaft and a plurality of batten spreader support brackets pivotally connected to said support member angularly about the axis of said shaft, said batten spreader support brackets each having means for readily releasably receiving and mounting a batten spreader support arm for supporting said camouflage screen whereby the batten spreader support arms can be readily assembled and disassembled and individually replaced in the event of damage or breakage;

slide means slidable on said shaft; and link members pivotally connected to said slide means and individually to said batten spreader support brackets for moving said batten spreader support means between said positions in response to sliding movement of said slide means on said shaft.

16. The collapsible support fixture of claim 15 wherein said support member at the top of said shaft comprises a polygonal support plate defining a plurality of edges along each of which one of said batten spreader support brackets is hinged.

17. The collapsible support fixture of claim 16 wherein said slide means comprises a collar and said link members are pivotally connected to said collar generally tangentially thereof.

18. The collapsible support fixture of claim 15, including over-center means to hold said batten spreader support means in said spread position automatically when said slide means reaches a predetermined position along said shaft.

19. In a support fixture for camouflage screen systems or the like wherein batten spreader support means are fixed to a shaft for pivotal movement relative thereto between a collapsed position generally alongside the shaft and a spread position generally radially of the shaft, the improvement comprising means on said batten spreader support means for releasably receiving and mounting individual batten spreader support arms whereby the batten spreader support arms can be readily assembled and disassembled and individually replaced in the event of damage or breakage, said batten spreader support arms being tapered generally toward the distal ends thereof, and said batten spreader support means including a plurality of batten spreader support brackets each including tapered channel means for releasably receiving one of said batten spreader support arms and holding the support arm by frictional enagement within said channel means.

20. In a support fixture for camouflage screen systems or the like wherein batten spreader support means are fixed to a shaft for pivotal movement relative thereto between a collapsed position generally alongside the shaft and a spread position generally radially of the shaft, the improvement comprising means on said batten spreader support means for releasably receiving and mounting individual batten spreader support arms whereby the batten spreader support arms can be readily assembled and disassembled and individually replaced in the event of damage or breakage, said batten spreader support means including a support member fixed generally to the top of a support shaft, a plurality of batten spreader support brackets pivotally connected to said support member angularly about the axis of said shaft for individually and releasably receiving and mounting said batten spreader support arms, slide means slidable on said shaft, link means connecting said slide means to said batten spreader support brackets for moving the batten spreader support means between said positions in response to sliding movement of said slide means on said shaft, and over-center arm means fixed to and depending from the underside of said batten spreader support brackets and pivotally connected to said link means to hold said batten spreader support means in said spread position automatically when said slide means reaches a predetermined position along said shaft.

21. In a support fixture as set forth in claim 20, wherein the pivot points of said link means on said slide means are above the pivot points of said link means on said depending arm means when said batten spreader support means are in said spread position.

22. A collapsible support fixture for camouflage screen systems or the like comprising:

a support shaft;

batten spreader support means fixed generally to the top of said shaft for pivotal movement relative thereto between a collapsed position generally alongside said shaft and a spread position generally radially of said shaft, said support means comprising a support member fixed generally to the top of said shaft and a plurality of batten spreader support brackets pivotally connected to said support member angularly about the axis of said shaft;

slide means slidable on said shaft;

link members pivotally connected to said slide means and individually to said batten spreader support brackets for moving said batten spreader support means between said positions in response to sliding movement of said slide means on said shaft; and over-center arm means fixed to and depending from the underside of said batten spreader support brackets and pivotally connected to said link members to hold said batten spreader support means in said spread position automatically when said slide means reaches a predetermined position along said shaft.

23. The collapsible support fixture of claim 22 wherein the pivot points of said link members on said slide means are above the pivot points of said link members on said depending arm means when said batten spreader support brackets are in said spread position.

* * * * *